US007913861B2

(12) United States Patent
Mueller et al.

(10) Patent No.: US 7,913,861 B2
(45) Date of Patent: Mar. 29, 2011

(54) SHELVING SYSTEM

(75) Inventors: Paul A. Mueller, Wadsworth, OH (US); Daniel J. Kump, Gates Mills, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 597 days.

(21) Appl. No.: 11/881,913

(22) Filed: Jul. 30, 2007

(65) Prior Publication Data

US 2007/0267367 A1 Nov. 22, 2007

Related U.S. Application Data

(60) Division of application No. 10/682,169, filed on Oct. 9, 2003, now abandoned, and a continuation-in-part of application No. 10/348,306, filed on Jan. 21, 2003.

(51) Int. Cl.
*A47F 7/00* (2006.01)

(52) U.S. Cl. ..... 211/59.3

(58) Field of Classification Search ..... 211/59.3, 211/184, 189, 59.2; 312/35, 61, 71
See application file for complete search history.

(56) References Cited

U.S. PATENT DOCUMENTS

| | | | |
|---|---|---|---|
| 1,971,749 | A | 8/1934 | Hamilton |
| 2,079,754 | A | 5/1937 | Waxgiser |
| 2,652,154 | A | 9/1953 | Stevens |
| 2,678,045 | A | 5/1954 | Erhard |
| 3,038,067 | A | 6/1962 | Dench et al. |
| 3,083,067 | A | 3/1963 | Vos et al. |
| 3,161,295 | A | 12/1964 | Chesley |
| 3,308,961 | A | 3/1967 | Chesley |
| 3,452,899 | A | 7/1969 | Libberton |
| 3,751,129 | A | 8/1973 | Wright et al. |
| 3,814,490 | A | 6/1974 | Dean et al. |
| 3,868,021 | A | 2/1975 | Heinrich |
| 4,042,096 | A | 8/1977 | Smith |
| 4,106,668 | A | 8/1978 | Gebhardt et al. |
| 4,269,326 | A | 5/1981 | Delbrouck |
| 4,303,162 | A | 12/1981 | Suttles |
| 4,351,439 | A | 9/1982 | Taylor |
| 4,378,872 | A | 4/1983 | Brown |
| 4,488,653 | A | 12/1984 | Belokin |
| 4,615,276 | A | 10/1986 | Garabedian |

(Continued)

FOREIGN PATENT DOCUMENTS

| | | |
|---|---|---|
| CH | 412 251 | 11/1966 |

(Continued)

OTHER PUBLICATIONS

FFr Yellow Pages® 2003 Product Catalog, "Merchandising Ideas Made Easy for Every Retail Environment!", Cover p. 9-11, 48-49, 52-58, Back Cover.

(Continued)

*Primary Examiner* — Jennifer E. Novosad
(74) *Attorney, Agent, or Firm* — Fay Sharpe LLP

(57) ABSTRACT

A product pusher device includes an elongate track having a front end, a rear end, and a rail and a paddle movably connected to the track for movement along the rail. The paddle has a front face for engagement with a rearmost one of a set of associated products located on the track. A foot protrudes from the paddle. The foot extends away from the front face and is slidably engaged with the rail. A biasing element is operatively connected to the paddle for urging the paddle toward the track front end.

26 Claims, 14 Drawing Sheets

U.S. PATENT DOCUMENTS

| | | | |
|---|---|---|---|
| 4,724,968 | A | 2/1988 | Wombacher |
| 4,729,481 | A | 3/1988 | Hawkinson et al. |
| 4,730,741 | A | 3/1988 | Jackle, III et al. |
| 4,762,236 | A | 8/1988 | Jackle, III et al. |
| 4,775,058 | A | 10/1988 | Yatsko |
| 4,830,201 | A | 5/1989 | Breslow |
| 4,907,707 | A | 3/1990 | Crum |
| 5,111,942 | A | 5/1992 | Bernardin |
| 5,161,704 | A | 11/1992 | Valiulis |
| 5,190,186 | A | 3/1993 | Yablans et al. |
| 5,203,463 | A | 4/1993 | Gold |
| 5,255,802 | A | 10/1993 | Krinke et al. |
| 5,351,839 | A | 10/1994 | Beeler et al. |
| 5,390,802 | A | 2/1995 | Pappagello et al. |
| 5,450,969 | A | 9/1995 | Johnson et al. |
| 5,469,976 | A | 11/1995 | Burchell |
| 5,542,552 | A | 8/1996 | Yablans et al. |
| 5,562,217 | A | 10/1996 | Salveson et al. |
| 5,634,564 | A | 6/1997 | Spamer et al. |
| 5,665,304 | A | 9/1997 | Heinen et al. |
| 5,673,801 | A | 10/1997 | Markson |
| 5,746,328 | A | 5/1998 | Beeler et al. |
| 5,839,588 | A | 11/1998 | Hawkinson |
| 6,041,720 | A | 3/2000 | Hardy |
| 6,082,557 | A | 7/2000 | Leahy |
| 6,129,218 | A | 10/2000 | Henry et al. |
| 6,142,317 | A | 11/2000 | Merl |
| 6,227,385 | B1 | 5/2001 | Nickerson |
| 6,234,328 | B1 | 5/2001 | Mason |
| D445,615 | S | 7/2001 | Burke |
| 6,382,431 | B1 | 5/2002 | Burke |
| 6,409,027 | B1 | 6/2002 | Chang et al. |
| 6,409,028 | B2 | 6/2002 | Nickerson |
| 6,464,089 | B1 | 10/2002 | Rankin, VI |
| 6,484,891 | B2 | 11/2002 | Burke |
| 6,527,127 | B2 | 3/2003 | Dumontet |
| 6,533,131 | B2 | 3/2003 | Bada |
| D472,411 | S | 4/2003 | Burke |
| 6,622,874 | B1 | 9/2003 | Hawkinson |
| 6,655,536 | B2 | 12/2003 | Jo et al. |
| 6,666,533 | B1 | 12/2003 | Stavros |
| D485,699 | S | 1/2004 | Mueller et al. |
| 6,772,888 | B2 | 8/2004 | Burke |
| 2001/0010302 | A1 | 8/2001 | Nickerson |
| 2002/0108916 | A1 | 8/2002 | Nickerson |
| 2002/0170866 | A1 | 11/2002 | Johnson et al. |
| 2003/0057167 | A1 | 3/2003 | Johnson et al. |
| 2003/0085187 | A1 | 5/2003 | Johnson et al. |
| 2003/0141265 | A1 | 7/2003 | Jo et al. |
| 2003/0217980 | A1 | 11/2003 | Johnson et al. |

FOREIGN PATENT DOCUMENTS

| | | |
|---|---|---|
| DE | 28 25724 | 12/1979 |
| EP | 270016 | 6/1988 |
| EP | 986980 | 3/2000 |
| FR | 2526338 | 5/1982 |
| FR | 2617385 | 1/1989 |
| GB | 2027339 | 2/1980 |
| GB | 2290077 | 12/1995 |
| JP | 59-218113 | 12/1984 |
| WO | WO 02/091885 | 11/2002 |

OTHER PUBLICATIONS

International Search Report, Jul. 19, 2005, Fasteners For Retail, Inc.

FIG. 7
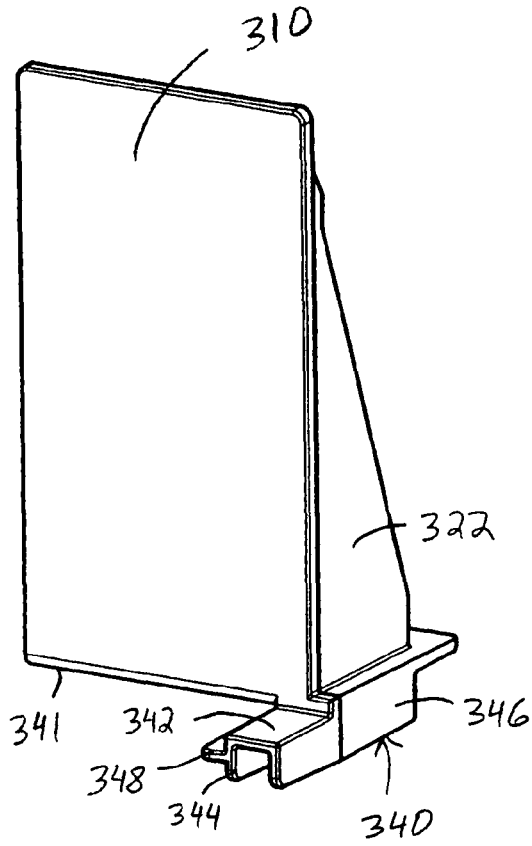
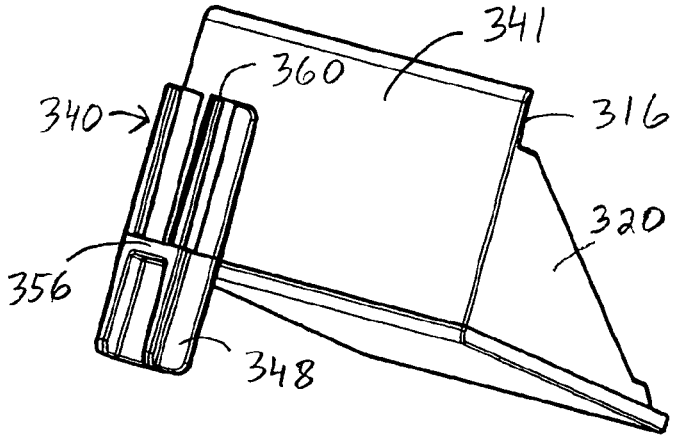
FIG. 8

FIG. 13
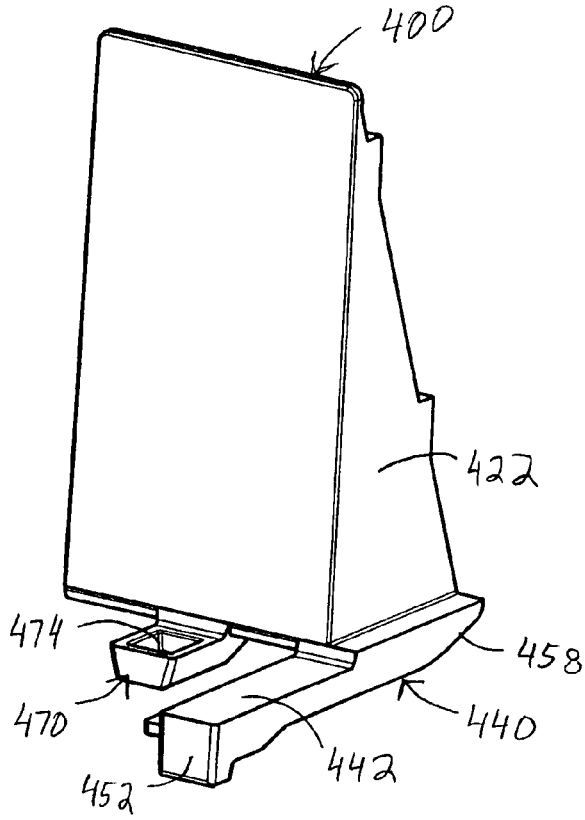
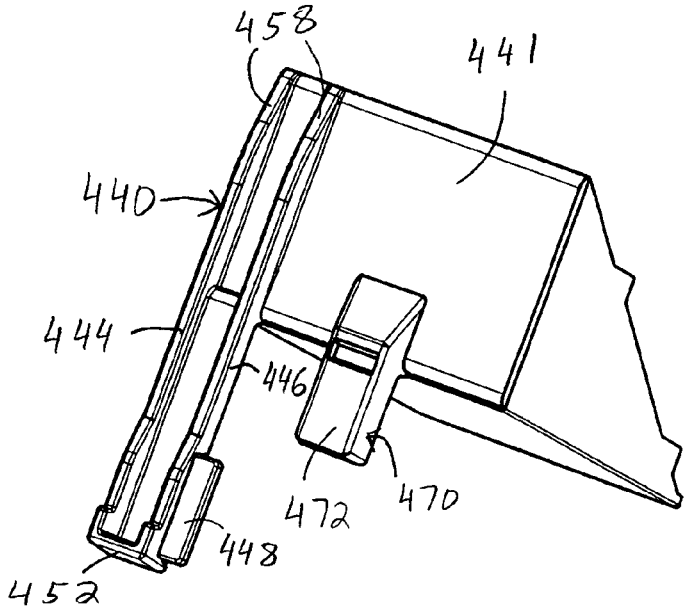
FIG. 14

SHELVING SYSTEM

This application is a division of U.S. patent application Ser. No. 10/682,169 which was filed On Oct. 9, 2003 now abandoned.

This application is a continuation-in-part of U.S. patent application Ser. No. 10/348,306 which was filed on Jan. 21, 2003 and is still pending.

FIELD OF THE INVENTION

The present invention generally relates to an adjustable shelving system. More specifically, the present invention relates to an adjustable forward-feeding display shelving system for storing and displaying merchandise of a variety of shapes and sizes and automatically delivering the merchandise to the front of the shelf. The shelving system can be removably attached to an associated shelf and is configured to organize merchandise on the shelf.

BACKGROUND OF THE INVENTION

Shelving is used extensively for stocking and storing products or merchandise in a variety of stores. Most stores have immovable shelving which is arranged back-to-back between aisleways. The nature of the fixed shelves makes it difficult to add and remove products. Moreover, such shelves make difficult the rotation of the shelved products, which involves moving the older stock to the front of the shelf and positioning new stock behind the older stock. For a number of important merchandising considerations, it is desirable that merchandise be displayed at the front of a shelf so that the customer is induced to purchase such forwardmost article. For example, if the goods are perishable or are subject to becoming stale (e.g. cigarettes, fruit juices, dairy products, or any item with an expiration date or a freshness date), it is important that the articles be removed in a first in, first out basis to maintain freshness. Also, if merchandise is not displayed at the front of a shelf, it may not catch the shopper's eye, which may cost the merchant sales.

In order to automatically move an item forward as the one before it is removed, numerous forward feed devices have been devised. There devices generally fall into three categories. The first category is inclined tracks, relying on gravity to feed, slide, or roll products forward. Gravity feeding is unpredictable in that various materials slide easier than others because of different weights and frictional interfaces between the products and the track. The second category employs conveyor belts which still use gravity to effect forward movement. These devices typically are cumbersome, expensive, and complicated, due to the need to properly tension and track the conveyor belts. The third category uses spring-biased paddles to feed the product forward. Such paddle-based forward feed devices have been found useful for certain merchandise.

However, a merchant with two or more different depths of shelving must purchase tracks of two or more depths, to employ the spring-biased paddles. There thus exists a need for a track system that is capable of accommodating shelving of varying depths.

Also, the current mounting designs of such spring biased paddles on rails is not optimum and, thus, leaves room for improvement.

Accordingly, it has been considered desirable to develop a new and improved track system for merchandise display which would overcome the foregoing difficulties and others while providing better and more advantageous overall results.

SUMMARY OF THE INVENTION

In accordance with the present invention, a new and improved product pusher device is provided. In one embodiment, the product pusher device includes an elongate track having a front end, a rear end and a rail. A paddle is moveably connected to the track for movement along the rail. The paddle comprises a front face for engagement with a rearmost one of a set of associated products located on the track. A foot protrudes from the paddle, the foot extending away from the front face and being slidably engaged with the rail. A biasing element is operatively connected to the paddle for urging the paddle towards the track.

According to another embodiment, a product pusher device includes an elongate track having a front end, a rear end, a rail and a length for placement on an associated shelf having a depth and a length wherein the track extends generally transverse to the length of the associated shelf. The track supports a plurality of associated products thereon. A paddle is moveably connected to the track for movement along the rail. The paddle includes a base portion, a front face connected to the base portion for engagement with a rearmost one of the associated products positioned on the track and a foot slidably engaged with the rail. The foot protrudes from the base portion. A biasing element is provided for urging the paddle towards the track front end.

According to still another embodiment of the present invention, a product pusher device includes an elongate track having a longitudinal axis and a rail extending along the longitudinal axis. A paddle is moveably connected to the track for movement along the rail. The paddle includes a base portion, a pusher face connected to the base portion for engagement with a rear most one of a set of associated products positioned on the track and a guide protruding from the base portion. The guide slidably engages the rail. A biasing element urges the paddle towards one end of the track.

In accordance with a further embodiment of the present invention, a merchandise display system is provided. The system includes an integrated base and divider assembly for supporting displayed merchandise wherein the base and divider assembly includes a base adapted for operative coupling to a shelf and a divider wall for dividing displayed merchandise into rows. The divider wall protrudes from the base such that the divider wall separates the base into a first portion having a pusher track and a second portion. A first rail is located on the pusher track. A pusher is mounted on the pusher track for pushing merchandise along the base first portion towards a front of the associated shelf. The pusher comprises a guide slidably engaged with the first rail.

Still other aspects of the present invention will become apparent to those of average skill in the art upon reading and understanding of the following detailed specification.

BRIEF DESCRIPTION OF THE DRAWINGS

The invention may take physical form in certain parts and arrangements of parts, several embodiments of which will be described in detail in this specification, and illustrated in the accompanying drawings, which form a part hereof and wherein:

FIG. 7 is a front perspective view of a paddle of the assembly of FIG. 4;

FIG. 8 is a bottom perspective view of the paddle of FIG. 7;

FIG. 13 is a front perspective view of a paddle of the assembly of FIG. 9;

FIG. 14 is a bottom perspective view of the paddle of FIG. 13;

DETAILED DESCRIPTION OF THE PREFERRED EMBODIMENTS

Figure 1A:
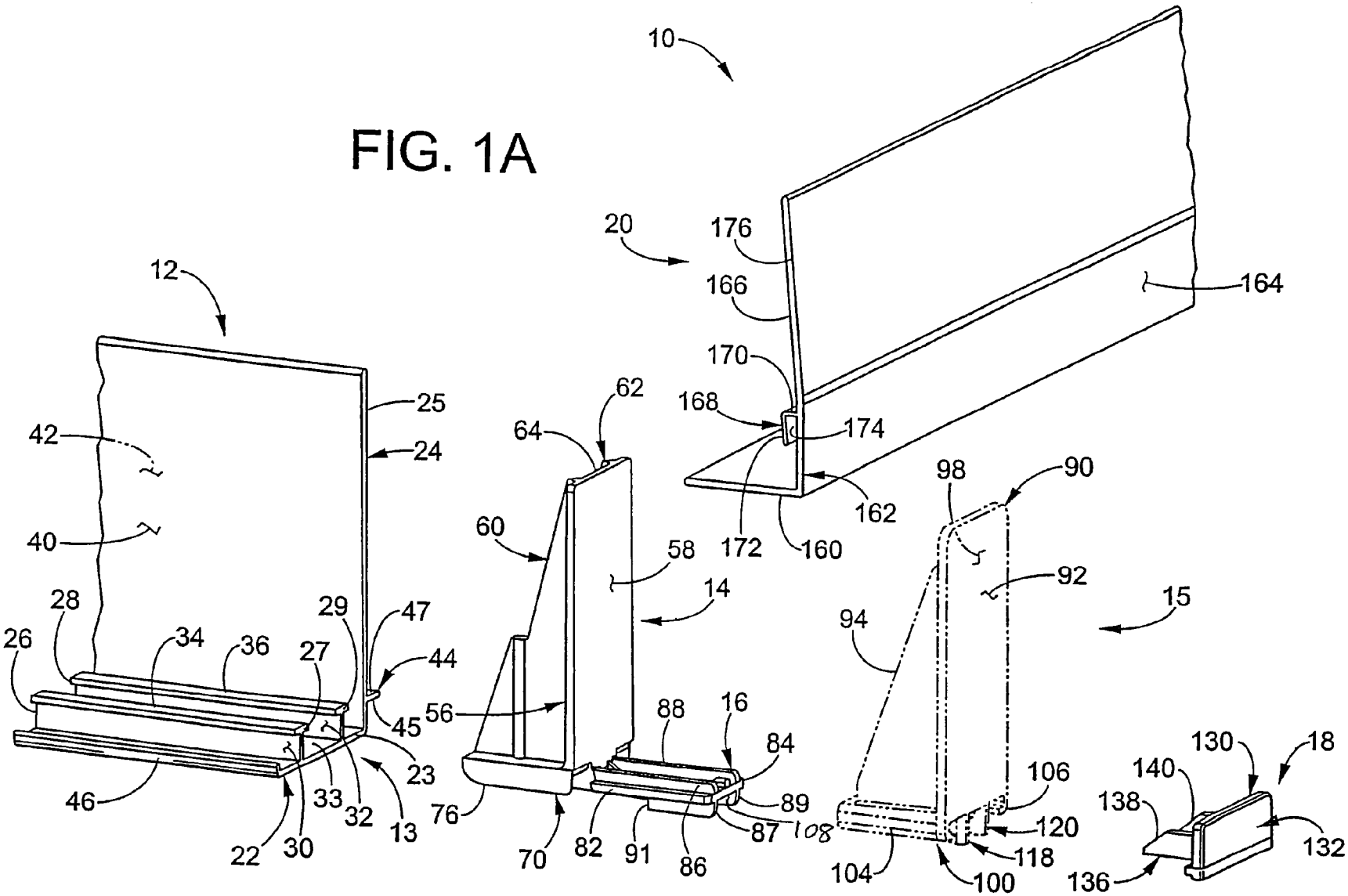
FIG. 1A is an exploded perspective view of a shelf management system according to the present invention, including a portion of an elongate track, two paddles in accordance with a first and a second embodiment, a front panel, and a front end clip.
Figure 1B:
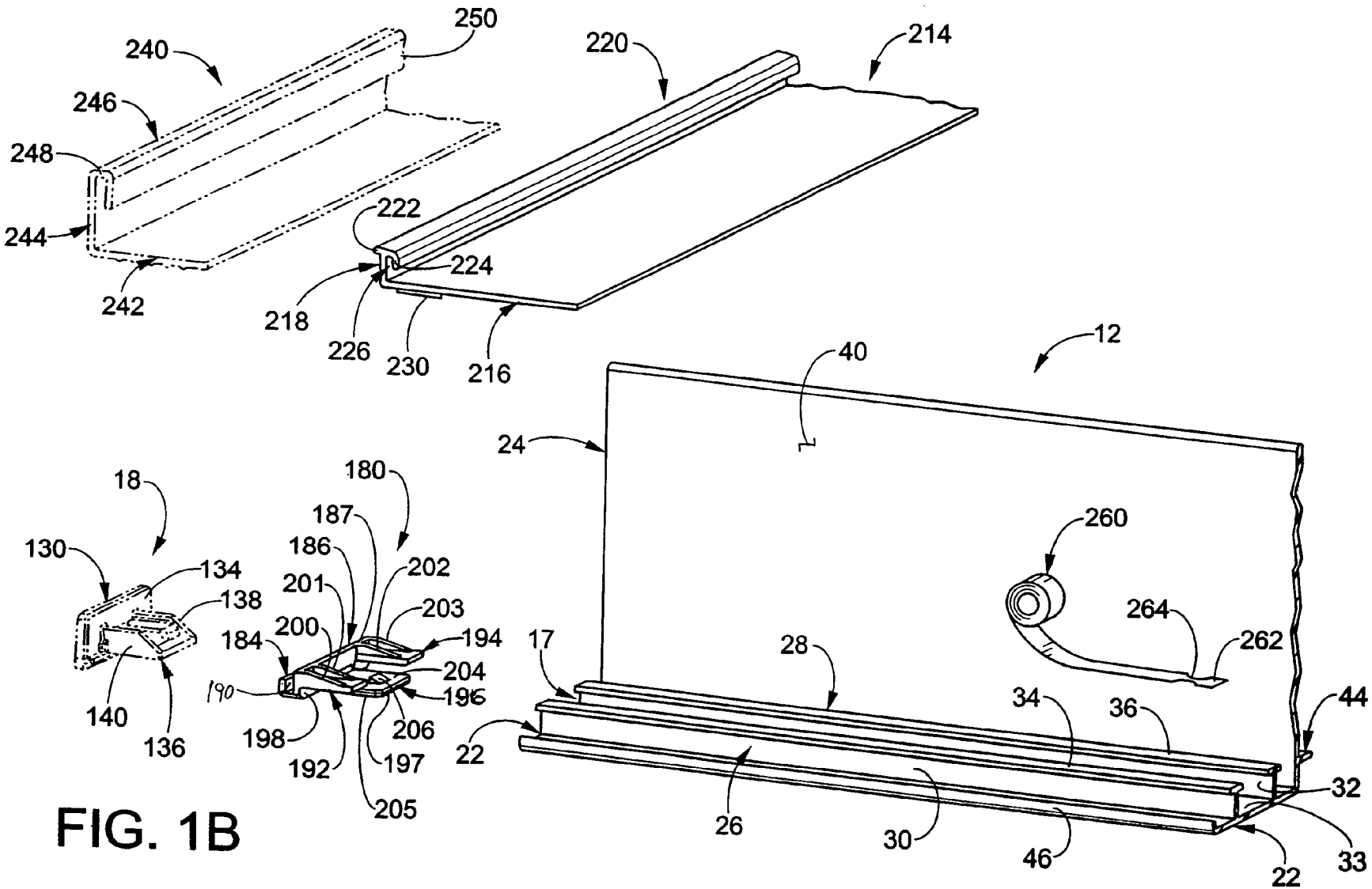
FIG. 1B is an exploded perspective view of a merchandise shelving system according to the present invention, including a portion of the elongate track, two rear panels and two rear end clips in accordance with the first and second embodiments.

Referring now to the drawings, wherein the showings are for the purposes of illustrating several preferred embodiments of the invention only and not for purposes of limiting same, FIGS. 1A and 1B show two embodiments of the shelf management system according to the present invention.

More particularly, FIG. 1A shows an exploded view of the components comprising a shelving system generally designated by reference numeral 10 including a portion of an elongate track 12, a product pusher paddle 14 with a foot 16 in accordance with a first embodiment, a front end clip 18, and a front panel 20. Also shown in phantom lines is an alternative product pushing paddle 15 without the foot in accordance with a second embodiment. The components of the shelving system 10 could be formed in accordance with the present invention from a conventional thermoplastic, such as polyvinyl chloride plastic or any other suitable plastic by extrusion, molding, or any suitable plastic forming technique. The shelving system 10 is configured in such a way so as to accept packages of various widths, depths, and configurations. More particularly, the spacing between adjacent tracks 12 can be adjusted to accommodate packages of different widths. Also, the shelving system can be employed on shelves of differing depths.

The track 12 is generally configured in an elongate orientation, including a front end portion 13 and a rear end portion 17 as shown in FIGS. 1A and 1B, respectively. The track 12 includes a base wall 22 and a side wall 24. The base wall 22 and the side wall 24 are perpendicular to each other. The base wall 22 of the track 12 includes a pair of T-shaped rails 26, 28 thereon. The T-shaped rails 26, 28 each include a vertical leg 30, 32, respectively extending transverse to an upper surface 33 of the base wall 22. The vertical legs 30, 32 each have a flattened horizontal surface 34, 36, respectively thereon. The flattened horizontal surfaces 34, 36 increase the support surface area for carrying product without impeding the sliding movement of product along the horizontal surfaces 34, 36 utilizing the available forces provided by the product feeding shelving system. The vertical legs 30, 32 space the flattened horizontal surfaces 34, 36 from the upper surface 33 of the base wall 22. The T-shaped rails 26, 28 extend collinear with the length of the track 12.

The track 12, at one side, includes the side wall 24 extending perpendicular to the base wall 22. The side wall 24 functions as a divider member to separate the shelf space into individual merchandise display areas. The side wall 24 includes a first face 40, a second face 42, and a flange 44. The flange 44 is generally transverse to the second face 42 of the side wall 24. The flange 44 is collinear with the length of the track 12. The flange 44 is proximal to the base wall 22 and generally coplanar with the flattened horizontal surfaces 34, 36 of the T-shaped rails 26, 28. The flange 44 has a horizontal surface 47. The base wall 22, at another side, includes a terminal edge 46, distal to the side wall 24, which extends upward generally perpendicular to the base wall 22. The terminal edge 46 is collinear with the length of the track 12. The front edges of the rails 27, 29, the front edge of the base wall 23, the front edge of the side wall 25, and the front edge of the flange 45 are coplanar and aligned generally with the front edge of the associated shelf, not shown.

As shown in FIG. 1A, the paddle 14 according to the first embodiment includes the foot 16. The paddle 14 further includes a pusher wall 56 with a front face 58 and a pair of gussets 60, 62 which extend rearwardly from a rear face 64. These are generally angled from the top of the pusher wall 56 to a base 70 of the paddle 14. The gussets 60, 62 serve to stiffen the pusher wall 56. The foot 16 extends forward of the pusher wall front face 58. An upper surface (shown in FIG. 2) of the base 70 serves as a spring carrier surface 72. At opposing sides of the spring carrier surface 72 are a pair of outside edges 76 and (not visible) projecting downward generally perpendicular to the spring carrier surface 72. The outside edges are parallel to one another and are spaced to slidably engage, along with an underside or sliding surface 80 of the spring carrier surface 72, the flattened horizontal surfaces 34, 36 of the T-rails 26, 28. The foot 16 extends forwardly transverse to the front face 58 of the pusher wall 56. The foot 16 includes a pair of opposing outside flanges 82, 84. A pair of product supporting arms 86, 88 are included on a top surface of the foot 16. A pair of guide legs 87, 89 are included on a bottom surface of the foot 16. The arms 86, 88 and legs 87, 89 are collinear with T-rails 26, 28 when the shelving system 10 is in an assembled arrangement, as will be described hereinafter.

As also shown in FIG. 1A, the second embodiment of the paddle 15 does not include a foot. However, the paddle 15 does include a pusher wall 90 with a front face 92 and a pair of gussets 94, 96 extending rearwardly from a rear face 98.

These generally angle from the top of the pusher wall 90 to a base 100 of the paddle 15. The gussets 94, 96 serve to stiffen the pusher wall 90. An upper surface of the base 100 serves as a spring carrier surface. At opposing sides of the spring carrier surface are a pair of rolled edges 104, 106 projecting downwardly and inwardly. The base 100 also includes a pair of legs 118, 120 extending transverse to a lower or sliding surface 108 of the base 100. The legs 118, 120 are configured to slidably engage the upper surface 33 of the base wall 22 to support and align the paddle 15 along the track 12.

Figure 2:
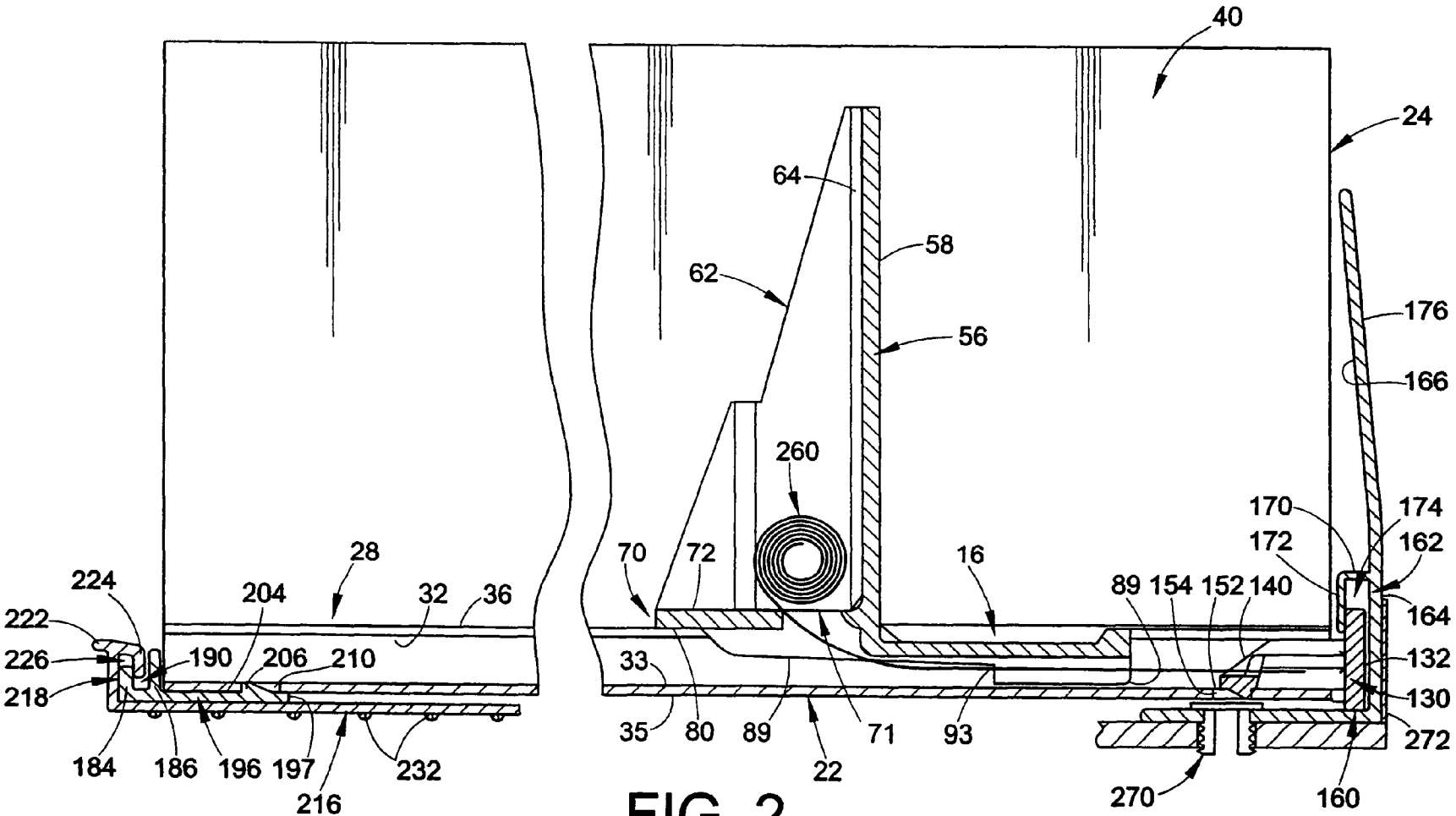
FIG. 2 is a sectioned view through the shelf management system of FIG. 1 in accordance with the first embodiment of the present invention.

With continued reference to FIG. 1A, a front end clip 18 for each track 12 is shown. This includes a vertical rectangular front plate 130 with a front face 132 and a rear face 134. The front plate 130 includes a mounting element 136 extending transverse to the rear face 134 of the plate 130. The mounting element 136 comprises a pair of vertically oriented opposing side walls 138, 140 and a bottom wall. The mounting element 136 of the front end clip 18 slides in between the T-rails 26, 28 in the front end portion 13 of the track and frictionally engages legs 30, 32, flattened horizontal surfaces 34, 36 and the upper surface 33 of the base wall 22. As shown in FIG. 2, a tooth 152 protrudes from a lower face of the clip and engages in a slot 154 in the track to fix the front end clip 18 to the front end portion 13 of the track 12 without the use of any glue or other adhesive material.

Also shown in FIG. 1A is the front panel 20. The front panel 20, which can be an extruded piece, is cut to fit the length of the shelf. The front panel 20, and a rear panel described hereinafter, generally allow the product tracks 12 to be stabily held so as to define a width for the product as well as to hold the product tracks 12 to the shelf at both the front and the back ends of the shelf, yet allowing them to slide sideways on the shelf. The front panel 20 and rear panel are advantageously configured such that a plurality of product tracks 12 can be slidably mounted to them. The front panel 20 is generally configured in an L-shaped arrangement with a base wall 160 and a front wall 162 extending upward generally transverse to the base wall 160. The front panel 20 may be comprised of a clear plastic material to allow a merchant or prospective purchaser a clear line of vision to the product being carried by the shelving system. The front wall 162 includes a front face 164 and a rear face 166. A downward extending flange 168 projects from the rear face 166 of the front panel 20. The flange 168 includes a first leg 170 which extends perpendicular to the rear face 166 and a second leg 172 generally perpendicular to the first leg 170. The second leg 172 extends downward generally parallel to the rear face 166. The first leg 170 and the second leg 172 form the downward extending flange configuration which provides an open slot 174. As shown in FIG. 2, the open slot 174 is configured to receive the front plate 130 of the front end clip 18. An upper portion 176 of the front wall 162 serves as a product retaining wall which extends upward and preferably angles slightly rearward from a location above the flange 168. The product retaining wall 176 serves as a forwardmost stopping surface for the shelf management system 10 and utilizes the rearward angle to hold products within the adjustable shelf management system 10 while the product is being urged forward in the manner described in greater detail hereinafter.

Figure 3:
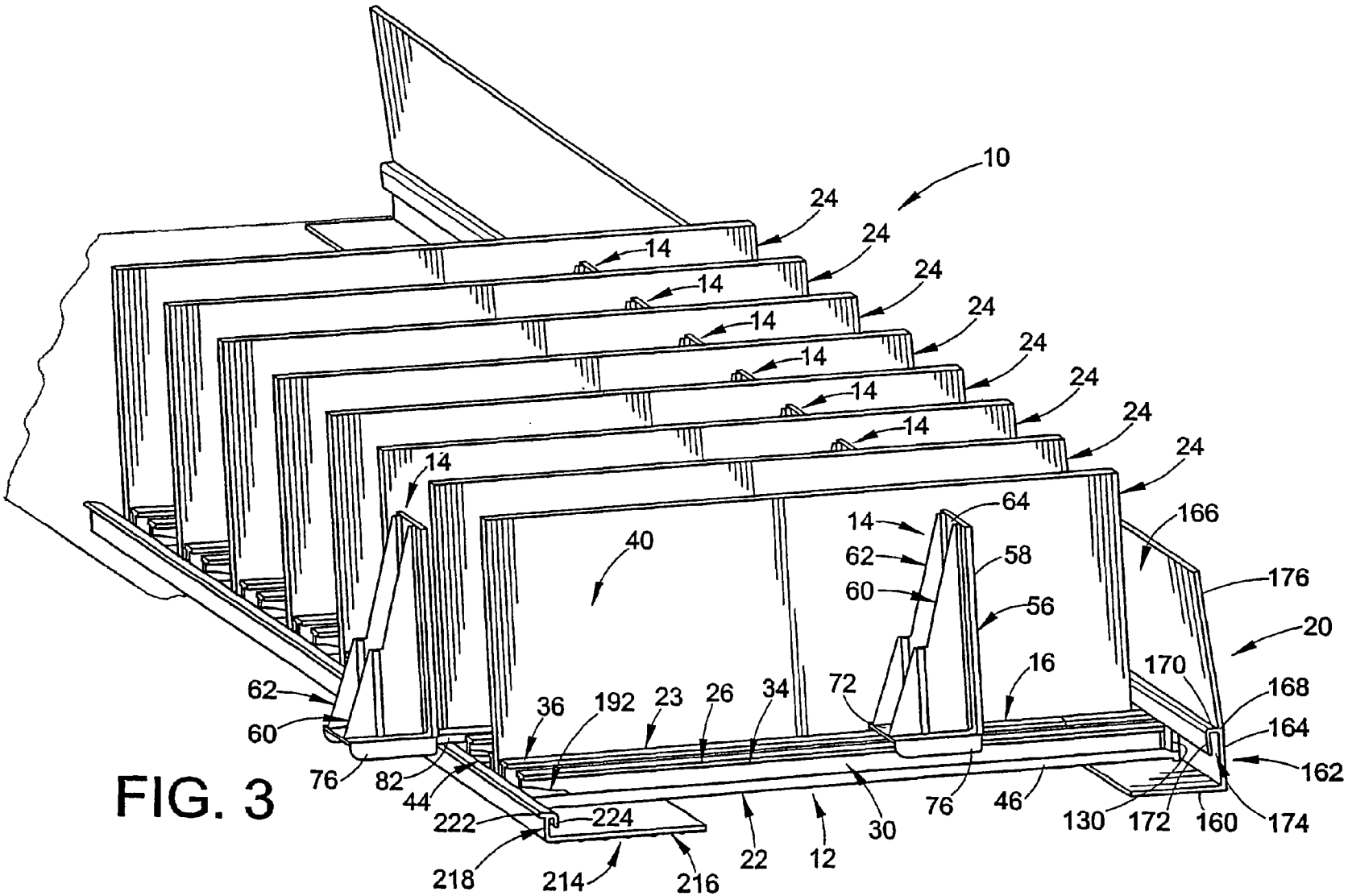
FIG. 3 is an assembled perspective view of the shelf management system of FIG. 1 in accordance with the first embodiment of the present invention.

As shown in FIG. 1B, a low profile rear end clip 180 cooperates with a low profile rear panel 214 in the first embodiment of the present invention. With reference now to FIG. 3, these two elements are configured in such a way as to allow a rear end of the pusher paddle 14 to extend rearward beyond the rear end portion 17 of the track 12. However, the foot 16 holds the pusher paddle on the track. The low profile rear end clip 180 includes vertically extending first and second walls 184, 186, respectively. A horizontal connecting wall (not visible) connects the first and second walls 184, 186 at their respective bottom edges thereby defining an upwardly open slot 190 between the first 184 and second 186 walls. Extending transverse to the second wall 186 are two opposing upper mounting tabs 192, 194 at opposing ends of the second wall 186. A lower mounting tab 196 extends transverse to the second wall 186 centered along a lower edge 198 of the second wall 186 between the two upper mounting tabs 192, 194. Each upper mounting tab 192, 194 includes a pair of integrally formed support walls 200, 201 and 202, 203, respectively, extending from a top edge 187 of the second wall 186 angularly to the front edge of the tabs. Planar bottom surfaces are provided for the mounting tabs 192 and 194. These are configured to slidingly engage the upper surface 33 of the track base wall 22. The lower mounting tab 196 has a planar upper surface 204 including an upward projecting tooth 206 generally centered between opposed side edges 205 and (not visible) of the lower mounting tab 196 proximal to a front edge 197. The upper surface 204 of the lower mounting tab 196 is configured to slidingly engage the bottom surface 35 of the track base wall 22. As shown in FIG. 2, the upward projecting tooth 206 engages an opening 210 in the base wall 22 between the T-rails 26, 28 thereby preventing disengagement of the rear end clip 180 from the track 12.

As shown in FIG. 1B, the low profile rear panel 214 of the first embodiment is defined by a base wall 216 and an upwardly extending rear wall 218. The rear wall 218 extends transverse to the base wall 216 and includes an L-shaped upper edge 220. The L-shaped upper edge 220 has a first leg 222 generally perpendicular to the rear wall 218 and a second leg 224 extending downward generally parallel to the rear wall 218. The first leg 222 and the second leg 224 form a downwardly open channel 226. The channel 226 is configured to engage the first vertically extending wall 184 of the rear end clip 180. As with the front panel, the rear panel 214 is cut to the length of the shelf and accommodates a plurality of product tracks 12. The base wall 216 of the rear panel 214 may include anti-skid layer 230 extending along the length of the bottom side of the base wall 216 proximal to the rear wall 218 for preventing movement of the rear panel in relation to the shelf. Alternatively, as shown in FIG. 2, a set of anti-skid bumps 232 may be used. The layer 230 or bumps 232 can be co-extruded or separately applied to the rear panel 214.

With reference now to the second embodiment, the front end clip 18 may be utilized also as the rear end clip as shown in FIG. 1B. For this purpose, a second embodiment of a rear panel 240 is employed. In this embodiment, the rear panel 240 includes a base wall 242 and a rear wall 244. The rear wall 244 projects upwardly transverse to the base wall 242. The rear wall 244 includes an L-shaped upper edge 246. The L-shaped upper edge 246 includes a first leg 248 projecting transverse to the rear wall 244 in a forward direction. A second leg 250 projects downward, generally parallel to the rear wall 244, from the first leg 248. In this embodiment, the rear panel 240 is similar to the front panel 20 but without a product retaining wall (upper portion).

According to the first embodiment, the paddle 14 is in sliding connection with the product track 12 (best shown in FIGS. 2 and 3). The sliding connection comprises a first and second pair of surfaces, with the first pair located adjacent the first T-shaped rail and the second pair of surfaces located adjacent the second T-shaped rail. One surface of the first and second pairs is formed on the top side of the outside flanges 82, 84 of the foot. The other surface of each of the first and second pairs is on the upper surfaces of the T-rails 26, 28. The first and second pairs of surfaces engage to resist separation of the paddle from the track. Additionally, there is a third pair of surfaces 87, 89 located on the bottom side of the foot 16. These engage adjacent surface 33 on the track base wall 22 to maintain alignment of the paddle 14 with the track 12. Furthermore, there is a fourth pair of surfaces located on the bottom side of the foot. These include respective notches 91 and (not visible) as shown in FIG. 1A. The notches engage a surface of the rear end clip 180 to halt rearward travel of the paddle on the track.

As illustrated in FIG. 2, the front face 58 of the paddle 14 extends generally normal to the upper surface 33 of the track 12. The front face 58 of the paddle is designed to allow the paddle to maintain contact with the products positioned directly in front of it. The spring carrier surface 72 and the sliding surface 80 of the paddle 14 are generally formed from the same section of material which extends rearward of the pusher wall 56 along a direction generally perpendicular to the front face 58. In the illustrated embodiment in FIG. 2, the gussets 60, 62 support the relationship between the pusher wall 56 and the base 70. The outer edges 76 and (not visible) of the base 70 extend downward transverse to the spring carrier surface 72. These outer edges form a fifth pair of sliding surfaces. These cooperate with a respective surface of the track 12. The fifth pair of surfaces engage to maintain alignment of the paddle 14 with the track 12. The base 70 includes a central opening 71, proximate to the rear face 64, which allows a roll spring to pass therethrough.

With reference again to FIG. 1A, the opposing outside flanges 82, 84 are designed to slide under the flattened horizontal surfaces 34, 36 of the rails 26, 28. The sliding surface 80 (FIG. 2) of the paddle 14 is designed to slide over the flattened horizontal surfaces 34, 36 of the rails 26, 28. Through the use of the opposing flanges 82, 84, the opposing outside edges 76, 78, and the rails 26, 28 of the track 12, a slidable positive lock between the track 12 and the paddle 14 is formed. The slidable positive lock reduces the likelihood of the paddle 14 separating or misaligning from the track 12 under high load.

As shown in FIG. 1A, the second embodiment of the paddle 15 (phantom lines) comprises first and second rolled edges 104, 106 which, in use, are located adjacent the rails 26, 28 of the track. These cooperate with the respective adjacent track 34, 36. The rolled edges engage the tracks to maintain alignment of the paddle with the track. Additionally, the legs 118, 120 of the second paddle 15 engage adjacent portions of the respective T-rails 26, 28. Such engagement helps resist separation of the paddle from the track.

The pushing surface or front face 92 extends generally normal to the upper surface 33 of the base wall 22. The spring carrier surface 102 and the sliding surface 108 are generally formed from the same section of material which extends rearward of the rear face 98 of the pusher wall 90 along a direction generally perpendicular to the front face 92 or pushing surface. In the illustrated embodiment in FIG. 1A, a pair of gussets 94 and (not visible) support the relationship between the pusher wall 90 and the base 100 of the paddle 15.

In both embodiments, a biasing element in the form of a spring 260 is used to bias the paddle 14 toward the front end portion 13 of the track 12. As illustrated in FIG. 2, the biasing element can be a roll spring 260. The roll spring 260 has characteristics which may make it desirable over various other types of springs, such as compression springs. For instance, the roll spring 260 naturally recoils back into its tightly wound initial state after being extended and released. Also, as the roll spring 260 is stretched, the force exerted by it is approximately the same during such stretching. It will be appreciated that other biasing elements may be used, i.e. elastic straps, coil springs, and other biasing members. The roll spring 260 is advantageous because it provides a uniform force throughout its extension, is simple to install, and does not require attachment to the foot 70. The roll spring 260 may be permanently, semi-permanently, or removably attached to the front clip 18. In the embodiment illustrated, the roll spring 260 is semi-permanently attached to the clip 18 by inserting a first end 262 of the spring 260 into a slot (not visible) in the clip. A spring portion 264 immediately adjacent the first end 262 is then bent 90° and inserted into a stem of the clip. The remainder of the spring is then rotated 90° around its longitudinal axis.

The balance of the roll spring 260 rests on a spring carrying surface 72 of the base 70 of the paddle 14. Due to the configuration of the roll spring 260, it does not need to be secured to the spring carrier surface 72. Alignment of the coiled section of the roll spring 260 is maintained by the rear face 64 of the pusher wall 56, and the inside walls (not shown) of the gussets 60, 62. The rear face 64 of the pusher wall 56 provides a front support and the inside walls of the gussets 60, 62 provide side restraints with respect to movement of the roll spring 260.

With reference again to FIG. 2, it is appreciated that in the first embodiment, the foot 16 of the paddle 14 limits the forward travel of the paddle 14. Although the forward travel of the paddle is inhibited by the foot 16, the foot 16 enables the pusher wall 56 to extend rearward beyond the rear portion 17 of the track 12 (as seen in FIG. 3). This additional rearward travel of the paddle 14 allows the entire length of the track to be utilized for storing and moving products. It will be appreciated that, in the second embodiment, using the paddle 15, the paddle 15 can traverse substantially the entire length of the track 12 but the pusher wall 90 does not travel beyond the rear end of the track 12.

The shelf management system 10 comprises the track 12 to underlie a plurality of products. The track 12 extends longitudinally between the front and rear end portions 13, 17, and laterally between the terminal edge 46 and the side wall 24. As illustrated in FIG. 3, the shelving system 10 and feeding assembly generally comprises a number of product tracks 12. It will be appreciated that the base walls 160, 216, 242 of the front and rear panels are of sufficient depth in order to provide the necessary stability and alignment to the product tracks extending therebetween. Due to the use of T-rails 26, 28 product tracks 12 decrease the contact surface area between the packages and the product supporting and feeding assembly such that friction may be reduced between the products and the assembly. The horizontal surface 47 of flange 44 of a first track 12 is coplanar with the flattened horizontal surfaces 34, 36 of a second adjacent track 12 to improve the product support and alignment as the products move along the track 12.

With reference now to FIGS. 2 and 3, a plurality of adjacent tracks 12 are shown stabily held by the front panel 20 and the rear panel 214. This configuration results in a secure connection of a plurality of tracks 12 within the shelving system 10 such that the individual tracks 12 cannot flop around. The front panel 20 may be attached to the shelf in any suitable manner, including friction fitting or permanent attachment (i.e. a Christmas tree clip 270 as shown in FIG. 2). The side wall 24 of each respective track 12 separates the products supported on individual tracks 12 such that the product carried by one product track 12 will not interfere with the movement of product carried by an adjacent product track 12. As shown, the side wall 24 is integral with the base wall 22. However, the side wall can be a separate divider wall (not shown). It is also appreciated that a product label 272 may be affixed to the front face 164 of the front panel 20.

Figure 4:
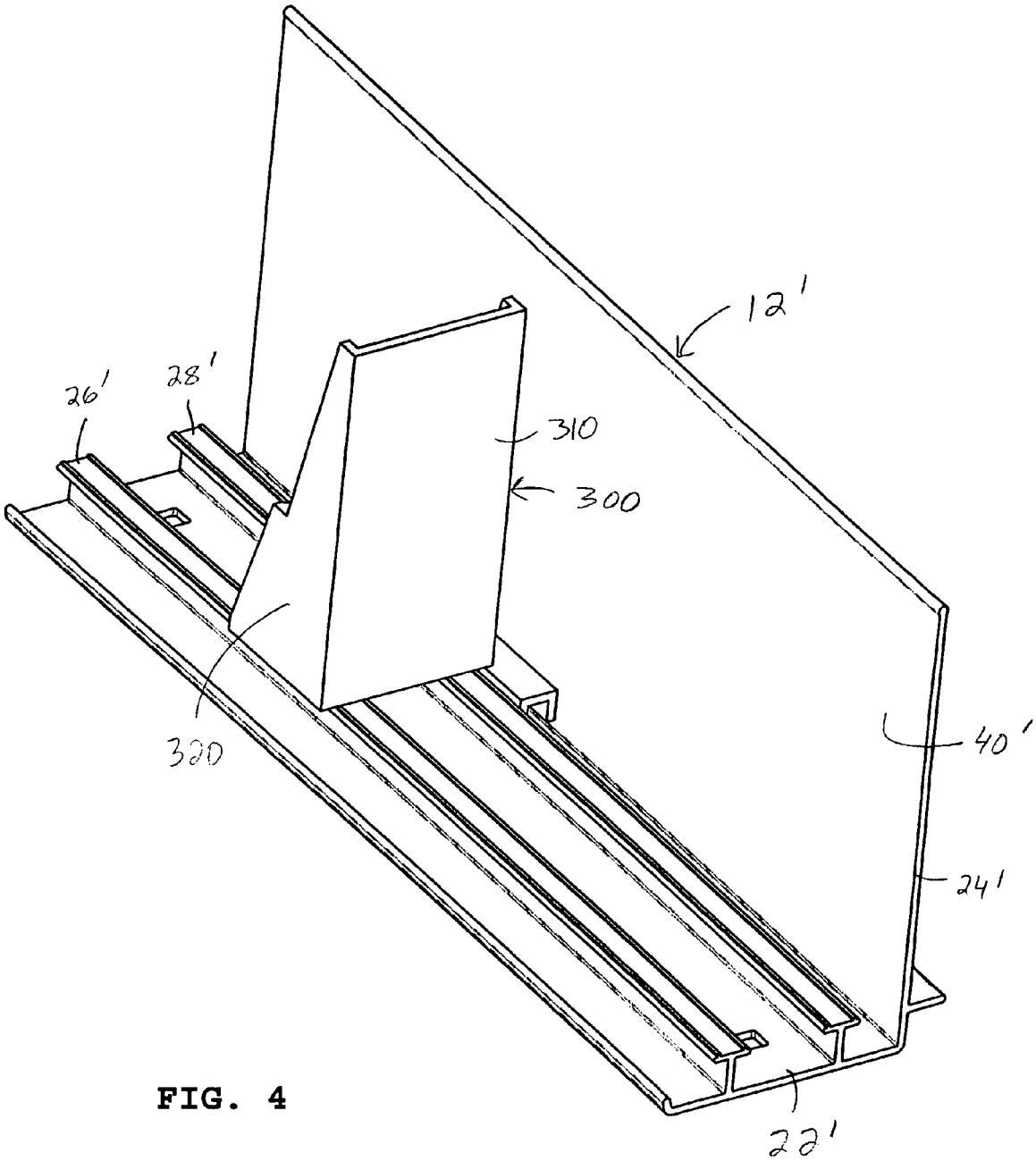
FIG. 4 is a perspective view of a shelf management system including an elongated track and paddle assembly according to a third embodiment of the present invention.
Figure 5:
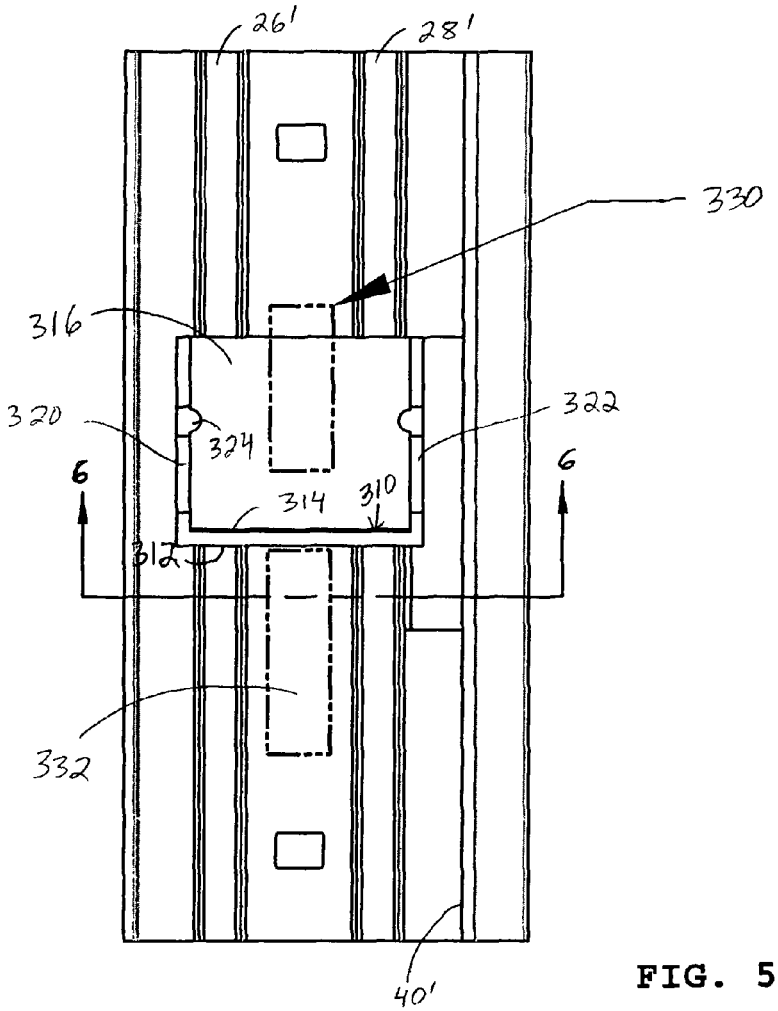
FIG. 5 is a reduced top plan view of the assembly of FIG. 4.
Figure 6:
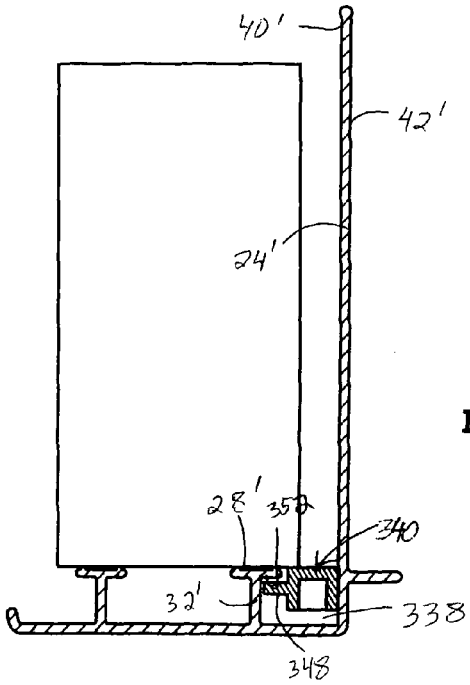
FIG. 6 is a front elevational view of the assembly of FIG. 5 along line 6-6.

With reference now to FIG. 4, another embodiment of a paddle is there illustrated. In this embodiment, like components are identified by like numerals with a primed (') suffix and new components are identified by new numerals. In this embodiment, a paddle 300 is slidably mounted on a track 12'. The track is generally configured as an elongated member oriented such that it extends from a front of a shelf to a rear of the shelf. The track includes a base wall 22'. Mounted on the base wall are a pair of T-shaped rails 26' and 28'. Spaced from the rails is a side wall 24'. The side wall includes a first face 40' and a second face 42' (FIG. 6). The paddle includes a pusher wall 310. With reference now also to FIG. 5, the pusher wall 310 includes a front face 312 for contacting merchandise and a rear face 314. The pusher wall 310 is mounted on a base 316. A pair of gussets 320 and 322 are located on opposed side edges of the pusher wall 310 and extend from the pusher wall to the base 316. The gussets are meant to reinforce the pusher wall 310. Reinforcing stakes on ribs 324 may also be provided adjacent the side walls. The stakes can be molded together with the side walls.

Positioned atop the base 316 is a spring 330. As with the embodiment of FIGS. 1-3, the spring 330 may be a coil spring. In this embodiment, the coil spring is not supported by the gussets 320 and 322 since the gussets are spaced a considerable distance from the relatively central location of the spring 330. Rather, the spring is simply held on the base 316. The spring 330 does not vary its location laterally in the process of coiling and uncoiling so that it would approach either of the gussets. The spring 330 is looped around the distal end of the base 316 and then extends forward, such that a central portion 332 is located between the rails 26' and 28', as is best seen in FIG. 5. If desired, the spring can have a front end (not visible) which is secured either to the track 12' or to a front clip (not illustrated), which can be of the type illustrated in FIGS. 1-3.

Defined between the side wall 24' and the second rail 28' is a slot 338 (FIG. 6). Positioned in the slot is a foot, guide or extension 340 of the paddle. With reference now also to FIG. 7, the foot is located adjacent the second gusset 322 and projects from a lower surface 341 (FIG. 8) of the base 316. The foot can be in the shape of an upside down U and can comprise a top wall 342. Projecting from opposite side edges of the top wall 342 are first and second arms or walls 46. Extending laterally from the first arm 344 is a flange 348. The flange is adapted to contact a lower surface 352 of the second rail 28' as is most evident from FIG. 6. At the same time, the second arm 346 abuts against the first face 40' of the side wall 24' to brace the paddle 300 and retard lateral movement thereof. Cooperation of the flange 348 and the second rail 28' retards vertical movement of the paddle 300. However, sliding movement along the rails 26', 28' is permitted. As is best shown in FIG. 8, a transverse stiffening wall 356 can extend between the two arms 344 and 346 between the ends thereof. It is also apparent from FIG. 8 that a rear end 360 the foot 340, can terminate short of the rear edge of the base 316, if so desired.

In this embodiment, the foot or guide 340 of the paddle is thus captured between the rail 28' and the sidewall 24'. It should, however, be recognized that the guide 340 could be captured between a rail and any sort of wall or approximately vertically extending protrusion of the track 12'. In other words, instead of the side wall 24' as illustrated in FIG. 6, some sort of protrusion could be employed in combination with a rail in order to capture the guide. In such a design, the side wall could be absent or could be located on the opposite side of the track. Also, a much wider track could be provided including a plurality of rails and, perhaps, a plurality of pushers mounted on such rails with each pusher having an extension that is captured between an adjacent rail and some sort of protrusion that may extend approximately vertically in relation to a base wall of the track.

Figure 9:
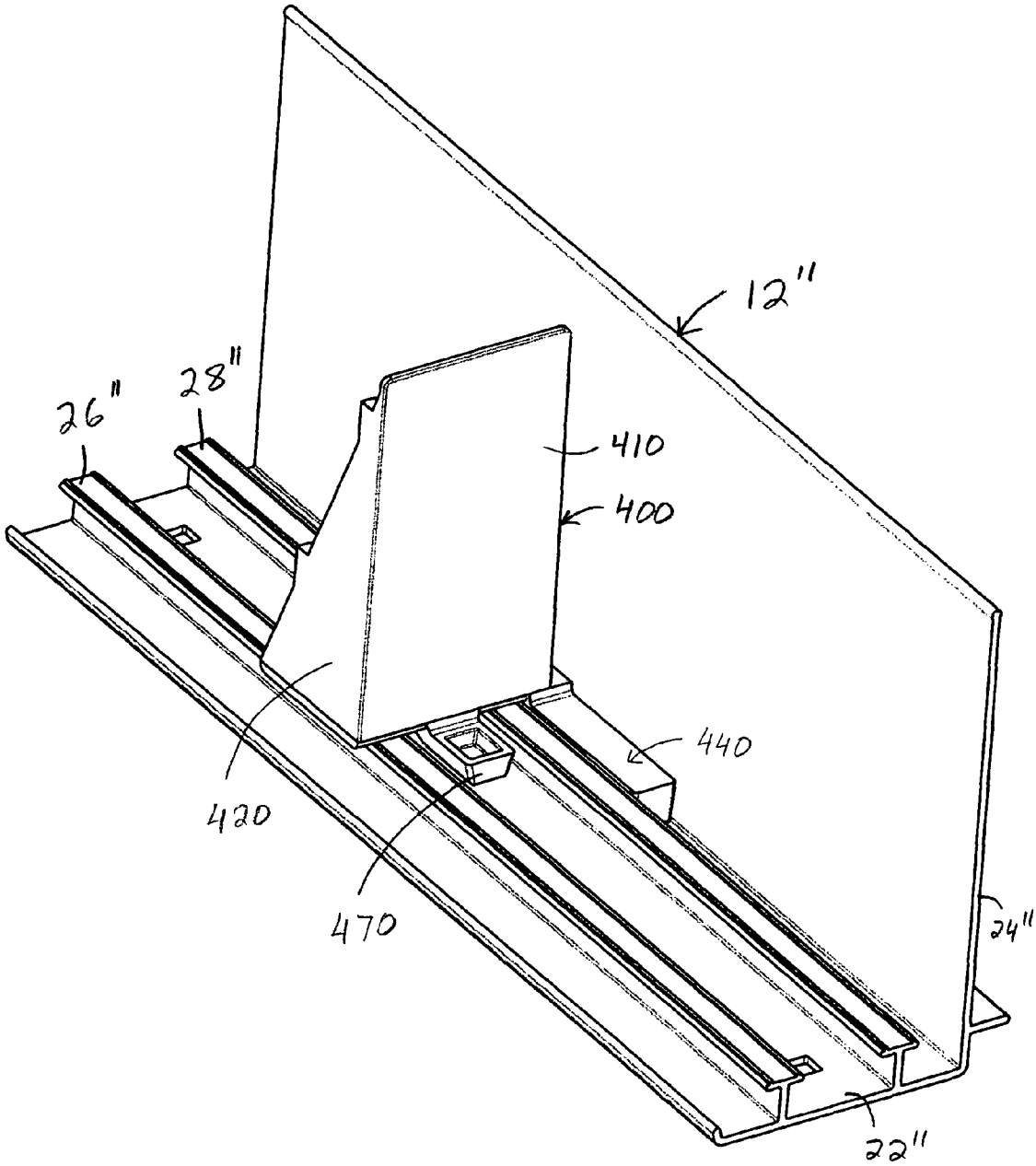
FIG. 9 is a perspective view of a shelf management system including an elongate track and paddle assembly according to a fourth embodiment of the present invention.
Figure 10:
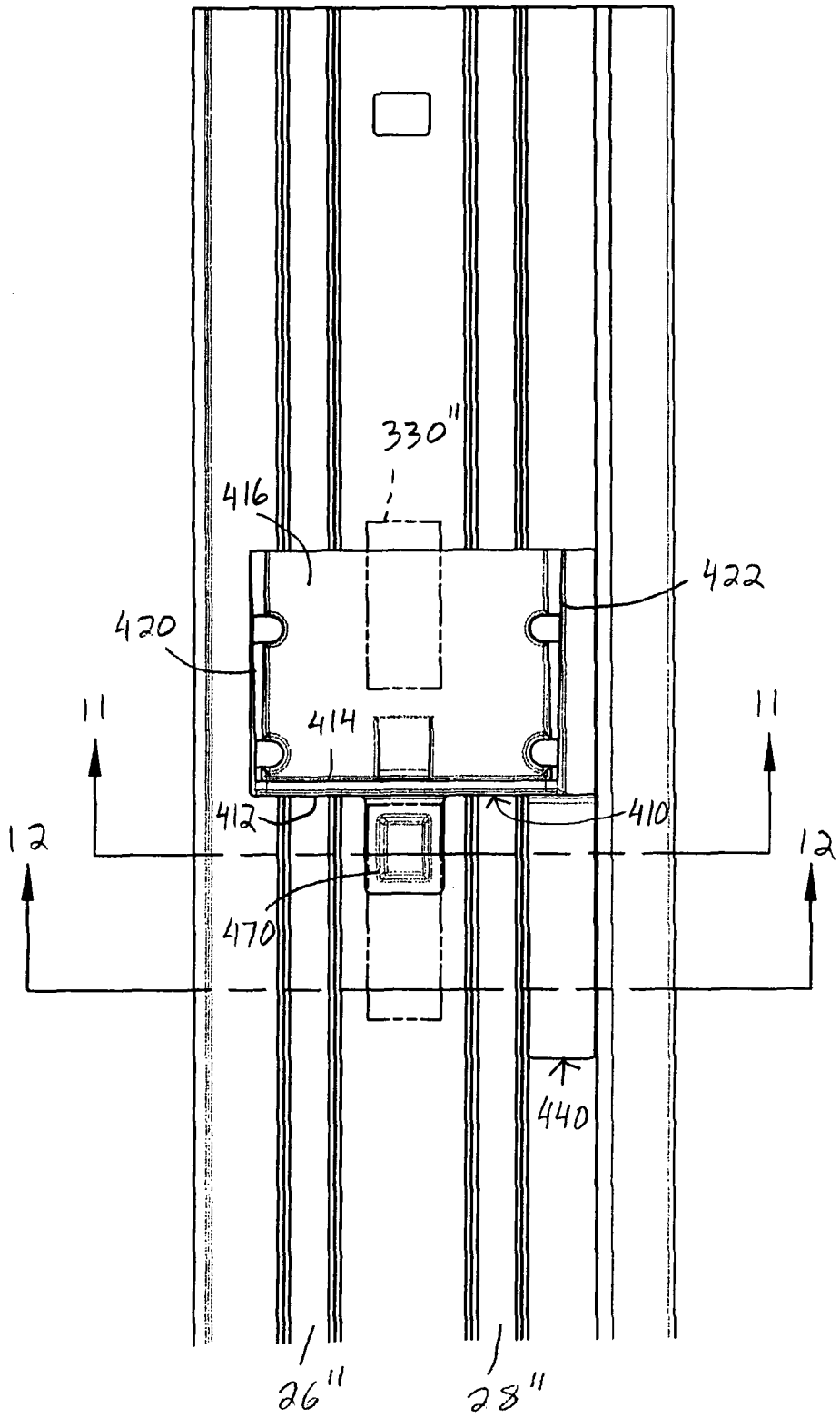
FIG. 10 is a reduced top plan view of the assembly of FIG. 9.

With reference now to FIG. 9, still another embodiment of a paddle is there illustrated. For ease of appreciation and understanding of this embodiment, like components are identified by like numerals with a double primed suffix (") and new components are identified by new numerals. In this embodiment, a track 12" includes a base wall 22" and a side wall 24". Located on the base wall 22" are a pair of spaced rails 26" and 28". Slidably mounted on the track 12" is a paddle 400. As best seen in FIG. 10, the paddle includes a pusher wall 410 having a front face 412 and a rear face 414. The pusher wall 410 extends from a base 416. Extending from the pusher wall 410 to the base 416 are a pair of gussets 420 and 422. These are located on opposed side edges of the pusher wall 410 and base 416.

A spring, such as a coil spring 330" is positioned on an upper surface of the base 416. The coil spring is significantly smaller in width than is the distance between the pair of gussets 420 and 422. As a result, the gussets do not support the coil spring 330" as it coils and uncoils. Rather, the coil spring is spaced by a considerable gap from an inner face of each of the gussets. Only the base 416 supports the coil spring 330".

Figure 11:
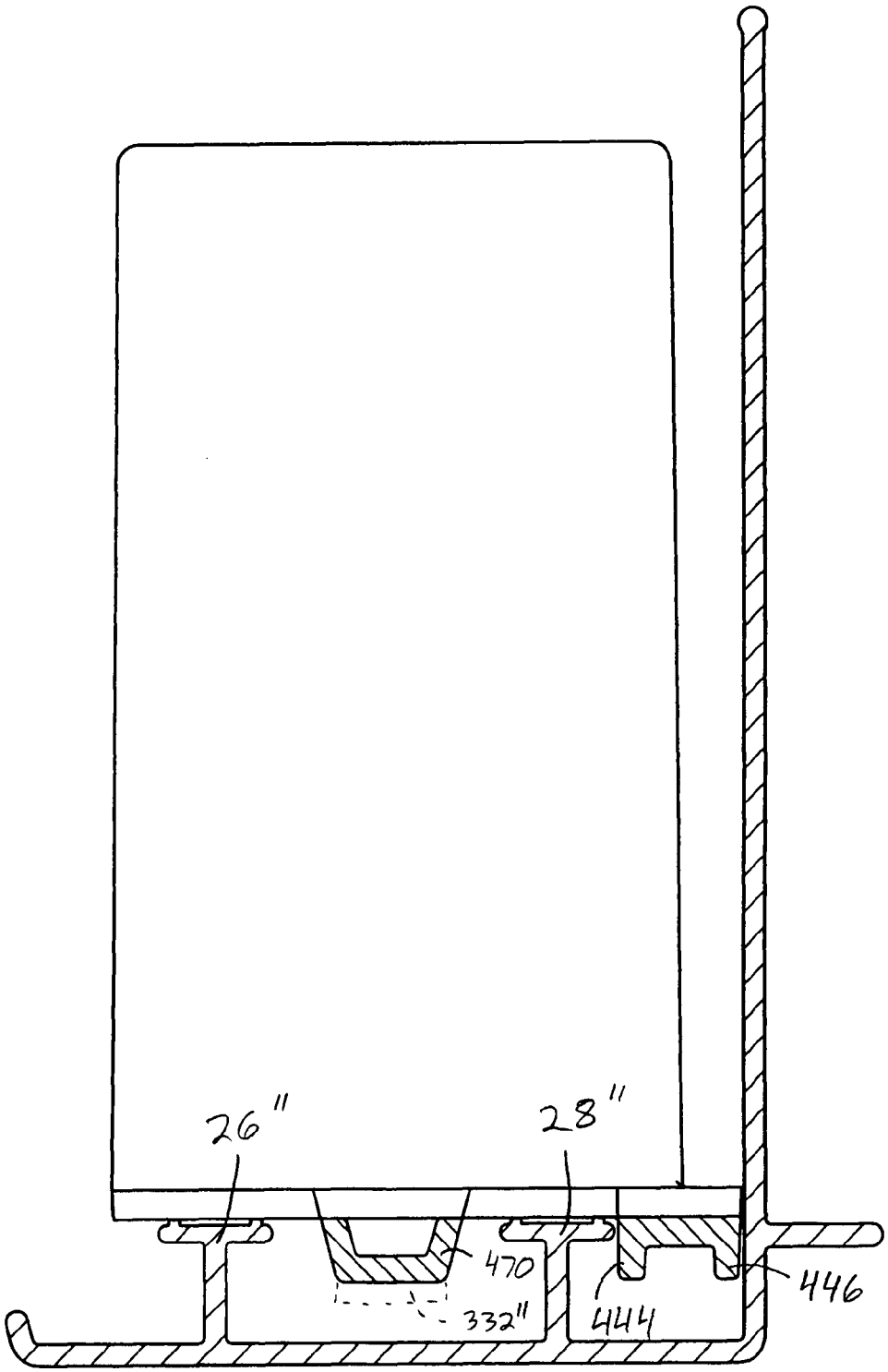
FIG. 11 is a front elevational view of the assembly of FIG. 10 along line 11-11.
Figure 12:
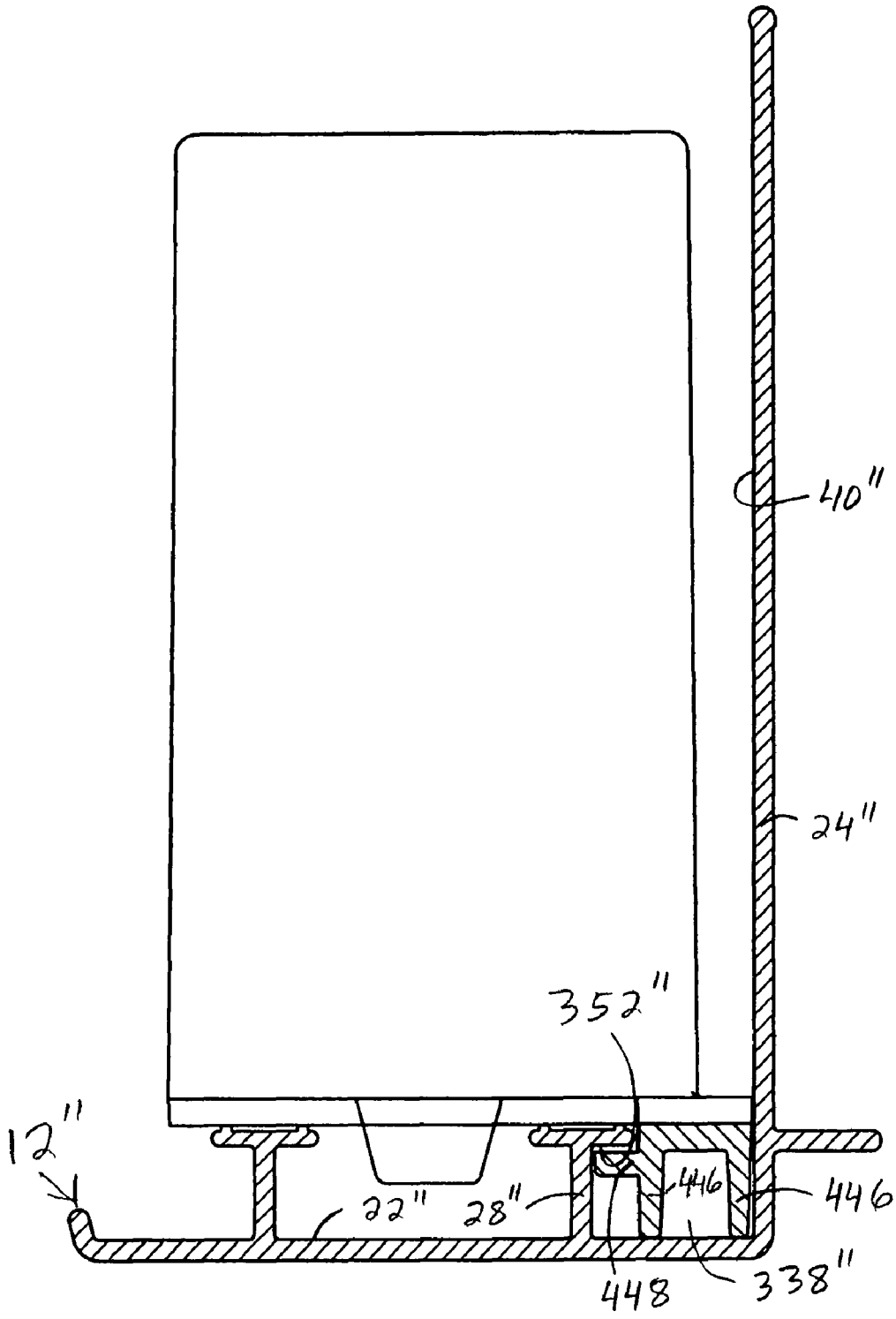
FIG. 12 is a front elevational view of the assembly of FIG. 10 along line 12-12.

Depending from the base 416 is a foot, guide, or extension 440. More particularly, the foot depends from a lower surface 441 of the base, as is best seen in FIG. 14. The foot comprises a top wall 442 (FIG. 13) as well as a first side wall 444 and a second side wall 446 which extend from opposed side edges of the top wall 442. As best seen in FIG. 13, the foot 440 can protrude transversely from the base 416 adjacent the second gusset 422. Protruding radially from the first wall or arm 444 is a flange 448. As can be best seen from FIG. 12, the flange is accommodated beneath a head of the second T-shaped rail 28" such that the flange is located beneath a lower surface 352" of the rail. It should be apparent from FIGS. 11 and 12 that the foot 440 is located in a slot 338" formed between the second rail 28" and the side wall 24". In this regard, the second arm 446 contacts a first face 40" of the side wall 24". Thus, the foot 440 braces the paddle 400 against the second rail 28" and the side wall 24". With reference to FIG. 14, a front face 452 can be provided for the foot 440.

With reference again to FIG. 13, the foot 440 can have arms of differing dimensions. For example, the arms can become thicker approaching a distal end of the foot 440 as shown in the embodiment of FIG. 13. Of course, the arms can have any other suitable desired configuration. The different thicknesses or widths of the arms or sidewalls can be seen by a comparison of FIGS. 11 and 12, which illustrate cross sections through the foot 440 at differing locations, as shown in FIG. 10. It is apparent from FIG. 12 that the arms 444 and 446 can contact the base wall 22" thereby bracing the pusher, not only against the second rail 28" and the side wall 24", but also against the base wall 22" of the track 12". It is noted that tapered surfaces 458 can be located on the rear ends of the arms beneath the distal end of the gusset 422, as also illustrated in FIG. 14.

Protruding from a central portion of the base 416 is a tab 470. The tab is meant to be used when the paddle 400 is fully retracted towards a back rail as illustrated in the embodiment of FIG. 3. In use, the tab 470 braces the paddle on the rear rail, when the paddle is fully retracted, to prevent it from wobbling. In the embodiment shown, the tab 470 can have a closed lower surface 472 (FIG. 14) and an open upper surface 474 (FIG. 13). The tab protrudes from a front edge of the base lower surface 441 in a spaced manner from the foot 440. It should be appreciated, however, that the tab can have many different designs. As is evident from FIG. 11, a portion 332" of the spring extends beneath the tab 470 and between the rails 26" and 28".

Figure 15:
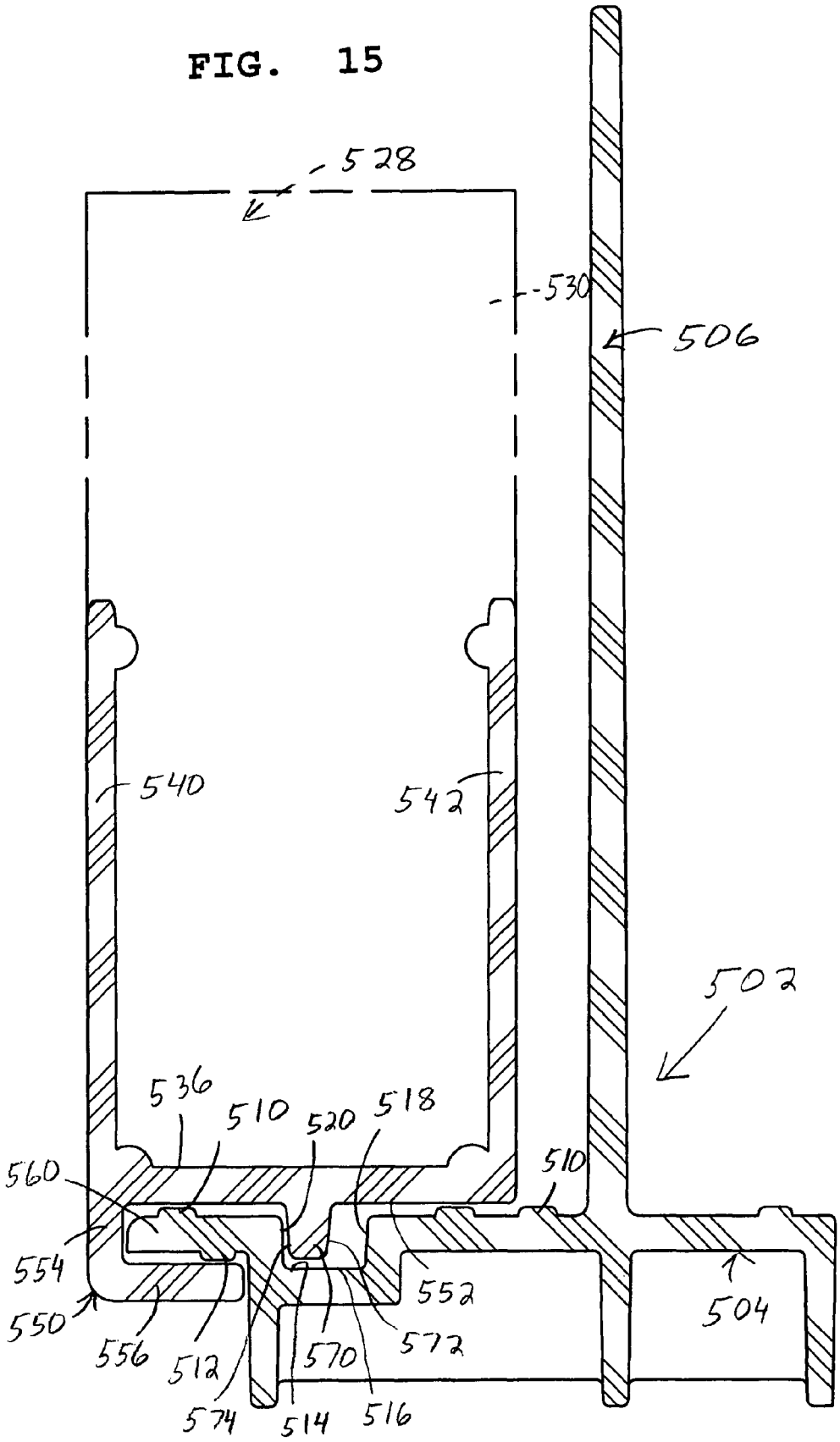
FIG. 15 is a rear elevational view of a shelf management system including an elongate track and paddle assembly according to a fifth embodiment of the present invention; and, FIG. 16 is a rear elevational view of a shelf management system including an elongate track and paddle assembly according to a sixth embodiment of the present invention.

With reference now to FIG. 15, yet another embodiment of the present invention is there illustrated. In this embodiment, a shelving system includes an elongate track 502 mounted to a panel (not illustrated). While mention has been made herein of both a front panel (such as panel 20 of FIG. 1A) and a rear panel (such as panel 214 of FIG. 1B), it should be appreciated by those of average skill in the art that both panels do not always need to be used. Rather, one could employ only a front panel or only a rear panel which would be engaged by a track. All that is necessary is that the at least one panel extend longitudinally along a subjacent shelf and that the track or plurality of tracks mounted to the panel extend transversely over the shelf so as to organize the product being presented on the shelf.

The track 502 comprises a base wall 504 and a side wall 506, which protrudes upwardly from the base wall. Defined on the base wall are a plurality of spaced top rails or ridges 510. Also defined on a bottom face of the base is a bottom rail 512. Extending longitudinally along the base wall 504 is a groove 514. The groove comprises a base wall 516 and a pair of spaced side walls 518 and 520.

Mounted on the track 502 is a pusher wall 528. The pusher can move in relation to the track 502 so as to be selectively located longitudinally along the length of the track 502 at a desired position. The pusher includes a wall 530 which is mounted on a base 536. As in the previous embodiments, a suitable spring (not illustrated) can be used to bias the pusher towards a front portion of the track 502. The coil spring can be positioned on the base 536. Extending from the pusher wall 530 to the base 536 are a pair of gussets for suitable reinforcing elements 540 and 542. These can be located on opposed side edges of the pusher wall 530 and the base 536.

Depending from the base 536 is a foot 550. More particularly, the foot depends from a lower surface 552 of the base 536. A first portion of the foot 554 can be aligned with the first gusset 540 if so desired. A second portion 556 of the foot can be oriented approximately normal to the first portion 554 and can be parallel to a plane of the base 536. As illustrated in FIG. 15, a somewhat U-shaped design is thus formed for accommodating a flange 560 of the track 502. Protruding from the lower surface 552 of the pusher wall base 536 is a protrusion 570. The protrusion includes a pair of side walls 572 and 574. It should be apparent from FIG. 15 that the first side wall 572 of the protrusion is spaced a considerable distance from the groove first side wall 518 but that the protrusion second side wall 574 is located adjacent the groove second side wall 520. In use, as the pusher 528 reciprocates on the track 502, the pusher base 536 rides on the top and bottom rails 510 and 512 such that the lower surface 552 of the pusher base contacts at least one of the top rails 510 while the second portion 556 of the foot or guide contacts the bottom rail 512. Due to the cooperation of the foot 550 and the protrusion 570 with the track 502, the pusher 528 cannot be lifted away from the track 502. Rather, the pusher must be slid to an end of the track and subsequently removed.

Figure 16:
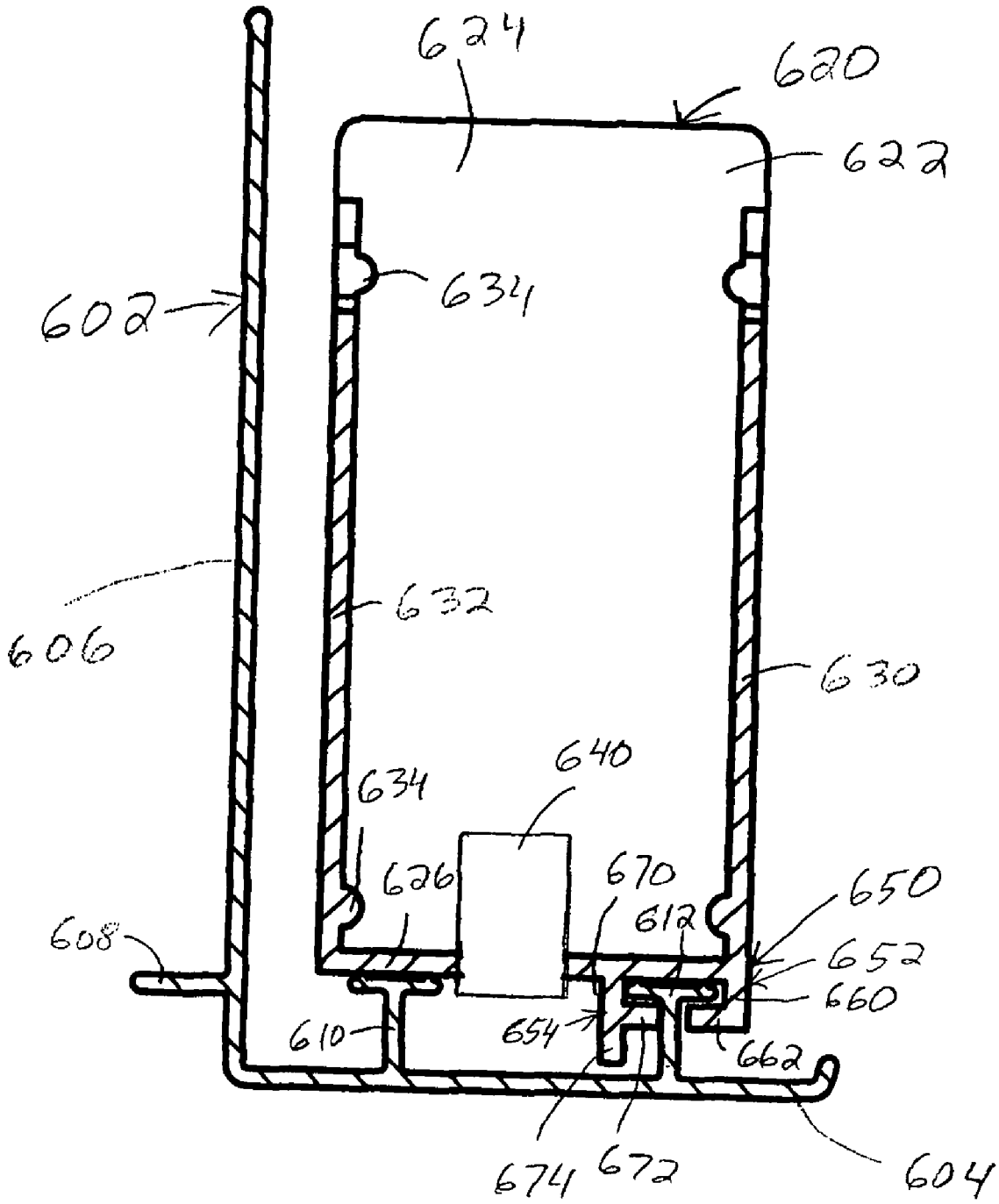

With reference now to FIG. 16, a further embodiment of the present invention is there illustrated. In this embodiment, a track 602 includes a base 604 and a sidewall 606. Protruding from the side wall is a flange 608. Extending parallel to a longitudinal axis of the track is a first rail 610. Spaced therefrom is a second rail 612.

Mounted on the track is a paddle 620. The paddle includes a pusher wall 622, which has a rear face 624, and a base 626. A first gusset 630 connects the pusher wall 622 to the base 626. Spaced from the first gusset is a second gusset 632. As is apparent, the gussets are located adjacent opposite side edges of the pusher wall and the base. If desired, reinforcing ribs 634 may be provided on the gussets. It should be apparent that the gussets serve to stiffen the paddle 620 and serve to retard any flexing of the pusher wall 622 in relation to the base 626.

Positioned on the base 626 is a spring 640. As in the embodiment of FIG. 1B, the spring can be a coil spring. It should be apparent from FIG. 16 that the side edges of the coil spring are positioned a significant distance away from the two gussets. In this way, the spring does not contact the gussets as it rolls and unrolls and is not supported or restrained thereby. It should be apparent that the coil spring has a portion that is looped around the base 626 such that the spring portion extends between the two tracks 610, 612 towards a front end of the track 602.

While mention has been made herein of the use of a coil spring, such as the spring 260 illustrated in FIG. 2, it should be recognized that other types of biasing means can also be provided for resiliently urging the different versions of pushers or paddles illustrated herein towards one end of an associated track. It is known in the art to use, for example, compression springs, elastic bands and other types of biasing means for this purpose.

A guide 650 mounts the paddle 620 on the track 602. In this embodiment, the guide comprises a first section 652 which extends from the base and is aligned with the first gusset 630 and a second section 654 which extends from the base in a spaced manner from the first section. The first section 652 includes a first wall 660 that is oriented parallel to a plane of the first gusset 630 and a second wall 662 which is oriented approximately normal to the first section. In other words, an approximately backwards L-shaped first guide section is thus provided. The second guide section 654 can comprise a first wall 670 that extends approximately normal to a plane of the base 626 and a second section 672 which extends approximately parallel to the plane of the base. Thus, a second approximately L-shaped guide section is provided. As is apparent, these two guide sections surround a horizontal portion of the second rail 612 and serve to slidably mount the paddle 620 on the second rail 612. It is noted that no similar guide is provided for the first rail 610. Rather, the paddle simply slides on the first rail as it moves along the second rail. An extension 674 may be provided for the guide second section 654. The extension can be oriented in a common plane with the guide second section first wall 670 as is illustrated. The extension 674 may prove useful to limit the retraction of the paddle 620 on the track 602 past a front panel (not illustrated) or a rear panel (not illustrated) should one be provided.

The advantages of the present design include a new and improved shelf management system including a product pusher. The product pusher can include a paddle which is extendible beyond the rear end of a track and is used for urging merchandise items toward the front end of the track. The shelf management system maintains the alignment of the associated products on the track. Additionally, the shelf management system may be quickly installed or rearranged without the need for tools. Furthermore, the present design provides for a paddle which may be used to extend the usable surface of the track, thereby providing functionality on a plurality of shelves having varying depths.

The invention has been described with reference to several embodiments, obviously, modifications and alterations will occur to others upon a reading and understanding of this specification. It is intended to include all such modifications and alterations insofar as they come within the scope of the appended claims and the equivalents thereof.

Having thus described the invention, what is claimed is:

1. A product pusher device comprising:

an elongate track having a front end, a rear end, and a rail;

a paddle movably connected to said track for movement along said rail, said paddle comprising a base and a front face for engagement with a rearmost one of a set of associated products located on said track;

a single guide protruding from said base, said guide extending away from said front face and being slidably engaged with said rail, said guide being spaced away from a central longitudinal axis of the front face of said paddle; and, a biasing element operatively connected to said paddle for urging said paddle toward said track front end.

2. The product pusher device of claim 1, wherein said biasing element comprises a spring.

3. The product pusher device of claim 1, wherein said rail includes a generally T-shaped cross-section.

4. The product pusher device of claim 3, wherein said guide of said paddle is captured between said rail and a wall of said track.

5. The product pusher device of claim 4, wherein said guide comprises a protrusion extending transversely from a wall of said guide and cooperating with said rail.

6. The product pusher device of claim 5 wherein said protrusion comprises a flange which extends away from said guide, said flange cooperating with said rail of said pusher track.

7. The product pusher device of claim 6 wherein said rail includes a generally T-shaped cross-section for cooperating with said flange of said guide of said paddle.

8. The product pusher device of claim 5 wherein said protrusion extends adjacent a side wall of said base.

9. The product pusher device of claim 1 wherein said guide comprises an L-shaped flange.

10. The product pusher device of claim 1 wherein said rail comprises a first rail and a second rail, which is spaced from said first rail.

11. The product pusher device of claim 10 wherein said guide is only engaged with said first rail.

12. The product pusher device of claim 10 wherein said paddle is slidably engaged with both said first rail and said second rail.

13. The product pusher device of claim 1 wherein said guide includes a first portion which extends approximately normal to a plane of said base and a second portion which extends approximately parallel to said plane of said base.

14. A product pusher device comprising:

an elongate track having a front end, a rear end, a rail, and a length for placement on an associated shelf having a depth and a length, said track supporting a plurality of associated products thereon;

a paddle movably connected to said track for movement along said rail and including:

a base portion including a central longitudinal axis extending in common direction with the elongate track, a front face connected to said base portion, for engagement with a rearmost one of the associated products positioned on said track, and a single guide, slidably engaged with said rail, said guide protruding from said base portion in a spaced manner from said central longitudinal axis of said base portion; and, a biasing element operatively connected to said paddle for urging said paddle toward said track front end.

15. The product pusher device of claim 14, wherein said track includes a wall and said guide of said paddle is captured between said rail and said wall of said track.

16. The product pusher device of claim 14, wherein said guide extends forwardly of said front face of said paddle.

17. The product pusher device of claim 16 wherein said guide comprises a pair of walls.

18. The product pusher device of claim 17 wherein said guide further comprises a flange that extends transversely of a plane of one of said pair of walls, said flange cooperating with said rail.

19. The product pusher device of claim 18 further comprising a stiffening wall extending between said pair of walls.

20. A product pusher device comprising:

an elongate track having a central longitudinal axis, a front end, a rear end, and a rail extending along said central longitudinal axis;

a paddle moveably connected to said track for movement along said rail, said paddle including:

a base portion, a pusher face connected to said base portion for engagement with a rearmost one of a set of associated products positioned on said track, and, a guide protruding from only one side of said base portion, said guide spaced apart from the central longitudinal axis of the track and slidably engaging said rail; and, a biasing element operatively connected to said paddle for urging said paddle towards one end of said track.

21. The product pusher device of claim 20 wherein said guide comprises a pair of walls and further comprising a tapered surface located at one end of said pair of walls.

22. The product pusher device of claim 21 wherein said guide includes a first portion which extends approximately normal to a plane of said base and a second portion which extends approximately parallel to said plane of said base.

23. The product pusher device of claim 22 wherein said rail comprises a first rail and a second rail, spaced from said first rail and wherein said guide second portion contacts only said first rail and said base contacts both said first rail and said second rail.

24. The product pusher device of claim 20 wherein said guide extends forwardly of said front face of said paddle.

25. The product pusher device of claim 20 further comprising:

a groove extending longitudinally along said track; and, a protrusion extending from a lower surface of said base portion, said protrusion being accommodated in said groove.

26. The product pusher device of claim 25 wherein said groove has a width larger than a width of said protrusion such that a first side wall of said protrusion is located adjacent one side wall of said groove and a second side wall of said protrusion is spaced away from a second side wall of said groove.

* * * * *